US005818476A

United States Patent [19]

Mey et al.

[11] Patent Number: 5,818,476

[45] Date of Patent: Oct. 6, 1998

[54] ELECTROGRAPHIC PRINTER WITH ANGLED PRINT HEAD

[75] Inventors: William Mey, Rochester; Thomas N. Tombs, Brockport; Thomas M. Stephany, Churchville; William J. Grande, Pittsford, all of N.Y.

[73] Assignee: Eastman Kodak Company, Rochester, N.Y.

[21] Appl. No.: 811,750

[22] Filed: Mar. 6, 1997

[51] Int. Cl.[6] ..... B41J 2/39; G03G 15/08

[52] U.S. Cl. ..... 347/40; 347/55; 399/266; 399/291

[58] Field of Search ..... 347/40, 42, 55, 347/9; 399/266, 291, 277

[56] References Cited

U.S. PATENT DOCUMENTS

| | | | |
|---|---|---|---|
| 3,879,737 | 4/1975 | Lunde | 347/55 |
| 4,318,606 | 3/1982 | Buholtz et al. | 399/277 X |
| 4,764,445 | 8/1988 | Miskinis et al. | 430/108 |
| 4,875,060 | 10/1989 | Masuda et al. | 347/147 |
| 5,144,340 | 9/1992 | Hotomi et al. | 347/55 |
| 5,268,767 | 12/1993 | Kurtin et al. | 347/40 X |
| 5,666,147 | 9/1997 | Larson | 347/55 X |

FOREIGN PATENT DOCUMENTS

| | | | |
|---|---|---|---|
| 61-225068 | 10/1986 | Japan | 347/42 |
| 63-64758 | 3/1988 | Japan | 347/40 |
| 04141459 A | 5/1992 | Japan . | |
| 6-31923 | 2/1994 | Japan | 347/40 |

OTHER PUBLICATIONS

A. R. Kotz, "Magnetic Stylus Recording", 1981, *Journal of Applied Photographic Engineering* 7, pp. 44–49.

*Primary Examiner*—Arthur T. Grimley
*Assistant Examiner*—Sophia S. Chen
*Attorney, Agent, or Firm*—Thomas H. Close

[57] ABSTRACT

Electrographic printing apparatus for forming a toner image on a recording medium, includes a magnetic brush having a rotatable magnetic core and a stationary outer shell. A developer supply supplies a magnetic developer powder including toner to the magnetic brush. A print head is located on the outer shell of the magnetic brush. The print head includes microchannels or magnetic strips for forming a plurality of parallel lines of developer, and transfer electrodes for selectively transferring toner from two or more locations within each line to a receiver moving relative to the print head. The parallel lines of developer are arranged at an angle with respect to the direction of movement of the receiver, thereby effectively increasing the resolution of the print head in a direction perpendicular to the movement of the receiver. A receiver electrode is arranged in spaced relation to the transfer electrodes to define a recording region through which the receiver is moved.

22 Claims, 4 Drawing Sheets

ELECTROGRAPHIC PRINTER WITH ANGLED PRINT HEAD

CROSS REFERENCE TO RELATED APPLICATIONS

Reference is made to U.S. Ser. No. 08/294,294, filed Aug. 23, 1994, now abandoned in favor of C.I.P. application U.S. Ser. No. 08/783,953, filed Jan. 16, 1997, entitled "ELECTROGRAPHIC PRINTING PROCESS AND APPARATUS" by William Mey et al., and to Ser. No. 08/620,655, filed Mar. 22, 1996, now abandoned in favor of C.I.P. application U.S. Ser. No. 08/782,272, filed Jan. 13, 1997, entitled "MICROCHANNEL PRINT HEAD FOR ELECTROGRAPHIC PRINTER" by William Grande, et al.

FIELD OF THE INVENTION

The invention relates generally to the field of printing, and in particular to electrographic printing methods and apparatus.

BACKGROUND OF THE INVENTION

An electrographic printing process wherein a magnetically responsive electrically conductive toner material is deposited directly on a dielectric receiver as a result of electronic current flow from an array of magnetically permeable styli into toner chains formed at the tips of the styli is disclosed in an article entitled "Magnetic Stylus Recording" by A. R. Kotz, Journal of Applied Photographic Engineering 7:44–49 (1981).

The toner material described by Kotz is a single-component, magnetically responsive, electrically conductive toner powder, as distinguished from multiple-component carrier/toner mixtures also used in electrophotographic development systems. The magnetically permeable styli described by Kotz are a linear array of magnetically permeable wires potted in a suitable material and arranged such that the ends of the wires are perpendicular to the receiver surface. A major advantage of this system is that it operates in response to relatively low voltage control signals (e.g. 10 to 100 volts), thereby allowing direct operation from inexpensive integrated circuits.

One shortcoming of the printing process described by Kotz is that the resolution of the printing system is limited by cross talk between the styli in the print head. It would be desirable to make a high resolution printer using an electrographic printing technique.

SUMMARY OF THE INVENTION

The present invention is directed to overcoming one or more of the problems set forth above. According to the present invention, electrographic printing apparatus for forming a toner image on a recording medium, includes a magnetic brush having a rotatable magnetic core and a stationary outer shell. A developer supply supplies a magnetic developer powder including toner to the magnetic brush. A print head is located on the outer shell of the magnetic brush. The print head includes means such as microchannels or magnetic strips for forming a plurality of parallel lines of developer, and transfer electrodes for selectively transferring toner from two or more locations within each line to a receiver moving relative to the print head. The parallel lines of developer are arranged at an angle with respect to the direction of movement of the receiver, thereby effectively increasing the resolution of the print head in a direction perpendicular to the movement of the receiver. A receiver electrode is arranged in spaced relation to the transfer means to define a recording region through which the receiver is moved. By angling the print head with respect to the receiver, and using the multiple transfer electrodes in each line of developer, increased resolution, reduced manufacturing cost, and improved performance is achieved.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has a number of advantages in using the concept described herein, and they are as follows:

1. Increases the resolution of the print head by eliminating the wall interference.
2. Adds redundancy by having additional transfer electrodes per image pixel.
3. Reduces electrical cross talk between adjacent transfer electrodes because they can be further apart.
4. Increases density due to additional transfer electrodes per image pixel.
5. Adds gray levels due to additional transfer electrodes per image pixel.
6. Improves throughput due to additional transfer electrodes per image pixel.
7. Reduces the difficulty of manufacturing the print head.
8. Increases the physical separation of the microchannels thereby isolating the lines of developer.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
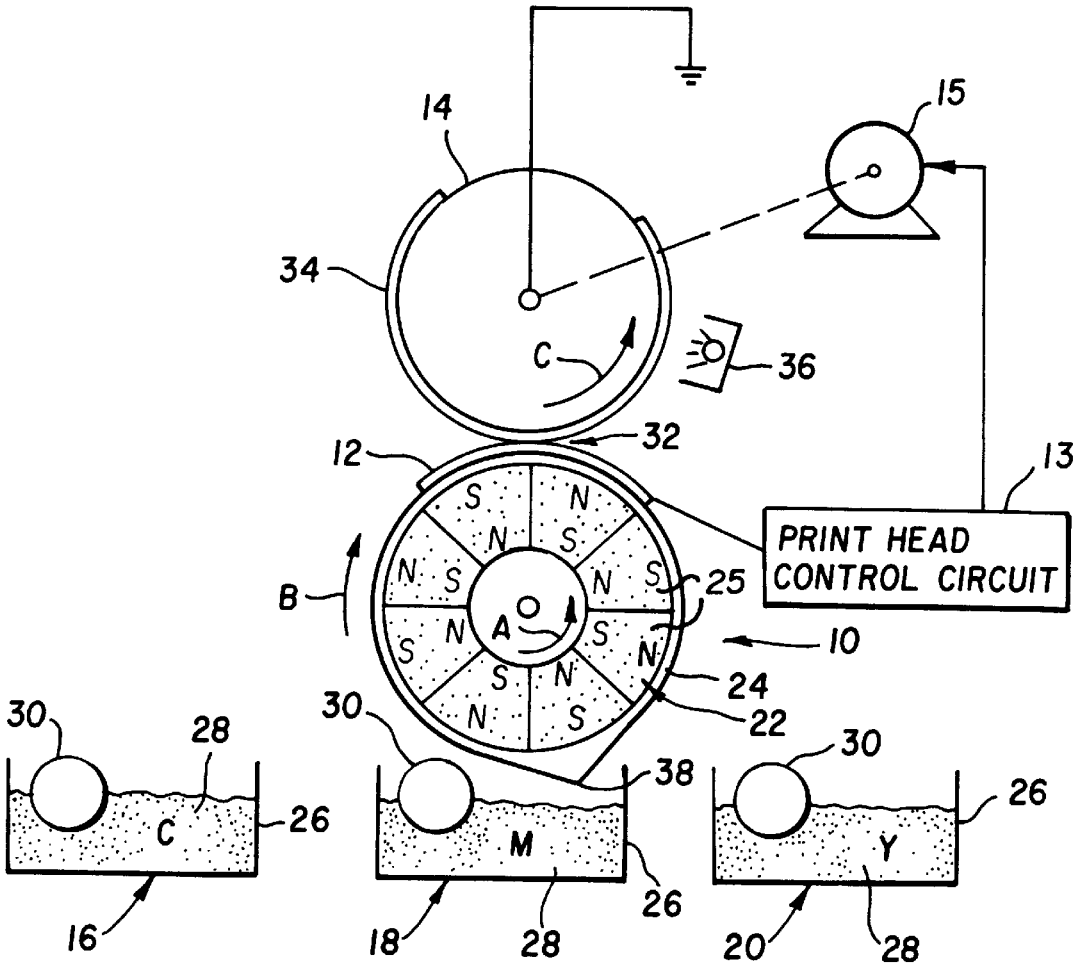
FIG. 1 is a schematic diagram of an electrographic color printer according to the present invention.

Referring to FIG. 1, an electrographic color printer according to the present invention is shown. The printer includes a magnetic brush generally designated 10, a print head 12 driven by a print head control circuit 13, a receiver electrode 14 driven by a stepper motor 15, and three developer supplies 16, 18 and 20 for supplying cyan, magenta and yellow developer powder to the magnetic brush 10, respectively. The print head 12 is configured to produce a plurality of parallel lines of developer, from which toner is transferred by transfer electrodes. In a printer adapted to print text as well as color images, a fourth developer supply (not shown) for supplying black developer powder to the magnetic brush may be provided. The stepper motor 15 is powered by print head control circuit 13 to synchronize the printing of the different colored developers.

The magnetic brush 10 includes a rotatable magnetic core 22 and stationary outer cylindrical shell 24 characterized by low magnetic permeability and high electrical conductivity. The rotatable magnetic core includes a plurality of permanent magnetic sectors 25 arranged about and extending parallel to the cylindrical surface of the shell 24 to define a cylindrical peripheral surface having alternating North and South magnetic poles. In operation, the magnetic core 22 rotates in a counter clockwise direction as indicated by arrow A to transport developer around the circumference of shell 24 in a clockwise direction as indicated by arrow B to the print head 12, where the developer is separated by the print head into discrete parallel lines of developer.

Each of the three developer supplies 16, 18, and 20 is constructed in a similar manner and is moveable from a position immediately adjacent the magnetic brush 10 as illustrated by supply 18, to a position away from the magnetic brush as illustrated by supplies 16 and 20 in FIG. 1. Each developer supply includes a sump 26 for containing a supply of magnetic developer 28, for example, a two component developer of the type having an electrically conductive, magnetically attractive carrier and a colored toner. A suitable developer is described in U.S. Pat. No. 4,764,445 issued Aug. 16, 1993 to Miskinis et al. The performance of the system can be optimized by employing the carrier having a balanced conductivity low enough to triboelectrically charge the toner particle, but high enough to conduct electricity. A rotatable magnetic feed roller 30 is actuable for delivering developer 28 from the sump 26 to the magnetic brush 10 in a known manner. Alternatively, the present invention can be employed with a printer using single component magnetic developers. In single component magnetic developers, the carrier and toner components of the developer are combined into a single particle that is transferred to the receiver.

The print head 12 is mounted on the outer surface of shell 24 opposite receiver electrode 14 to define a recording region 32. A receiver 34, such as dielectric coated or plain paper, is wrapped around the receiver electrode 14 and moved through the recording region 32 in the direction of arrow C with one surface in contact with receiver electrode 14. Alternatively, the direction of the receiver and the flow of developer may be in opposite directions. A fusing station 36 may be provided as is known in the art to fuse the toner image to the receiver 34. The fusing station 36 may comprise for example a radiant heat source or a hot roller.

In operation, a first developer supply, say the magenta supply 18 is moved into position adjacent the magnetic brush 10. The magnetic feed roller 30 is actuated to supply developer 28 to the magnetic brush 10. The developer 28 is transported around the periphery of the magnetic brush 10 to the recording region 32, where pulses are selectively applied to an array of transfer electrodes in print head 12 by print head control circuit 13 to transfer toner from the discrete lines of developer 28 to the receiver 34 in an imagewise manner as the receiver is moved by stepper motor 15 through the recording region 32. After the first color component of the image (e.g. magenta) is formed on the receiver 34, the remaining developer is removed from the magnetic brush 10.

Means are provided on the shell 24 of the magnetic brush 10 such as a lip 38 which extends a distance from the magnetic core 22 so that as the developer is transported around the periphery of the shell 24, it is moved away from the influence of the magnetic core 22 to the point where it falls back into the sump 26. Alternatively, another magnetic brush and sump (not shown) having only magnetic carrier (no toner) may be provided for cleaning the outer shell 24. The magnetic carrier is transported around the magnetic brush to scavenge residual toner from the magnetic brush 10 and print head 12. Such an arrangement is called a magnetic brush cleaning station in the prior art. Alternatively, a separate magnetic brush 10 and print head 12 may be provided for each color of developer, thereby avoiding the need to clean the magnetic brush and print head after each color.

Next, the developer supply 18 is moved away from the magnetic brush 10 and the next developer supply (e.g. the yellow developer supply 20) is moved into position to replace it. The receiver 34 is repositioned by print head control circuit 13 and stepper motor 15 to record the yellow component of the image and insure registration between the various color components and the recording process described above is repeated. Finally, the cyan component of the full color image is recorded in a similar fashion. After the three image components are recorded, the full color image is fused to the receiver 34 at fusing station 36. Alternatively, each color developer may be fused or tacked (i.e. partially fused to better adhere the toner to the receiver prior to subsequent final fusing) after deposition and prior to the deposition of the subsequent color.

A potential limitation with the printing apparatus described in FIG. 1 is that for very high resolution printing, e.g. greater than 300 dots/inch, the print head 12 becomes increasingly difficult to manufacture. Also, for high resolution print heads, cross talk between lines of developer limits resolution. Additionally, the transfer electrodes must be close enough together such that adjacent image pixels overlap to form flat-field images and yet far enough apart to eliminate cross talk between them. These problems are solved according to the present invention by providing at least two transfer electrodes per line of developer and angling the lines of developer with respect to the receiver 34 so that the effective spacing between individual dots produced by the printing apparatus is less that the spacing between the parallel lines of developer.

Figure 2:
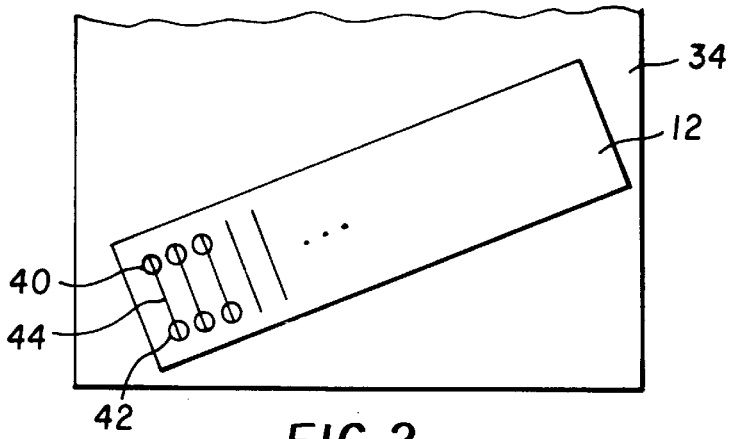
FIG. 2 is a schematic diagram illustrating a printer having plural transfer locations in each line of developer, and the lines being angled according to the present invention by angling the print head.
Figure 3:
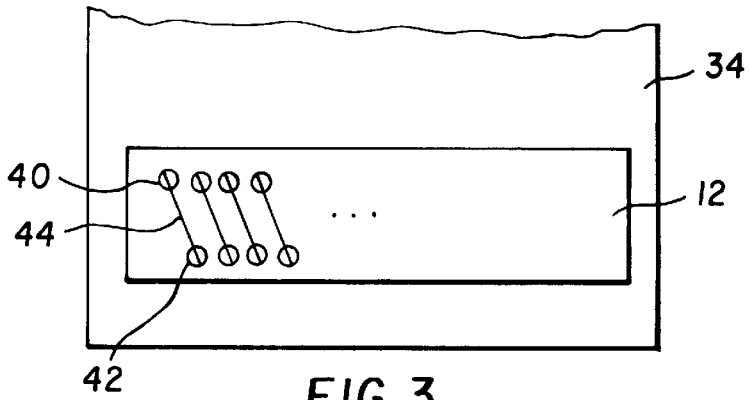
FIG. 3 is a schematic diagram illustrating a printer having plural transfer locations in each line of developer, and the lines being angled according to the present invention by angling the lines on the print head.
Figure 4:
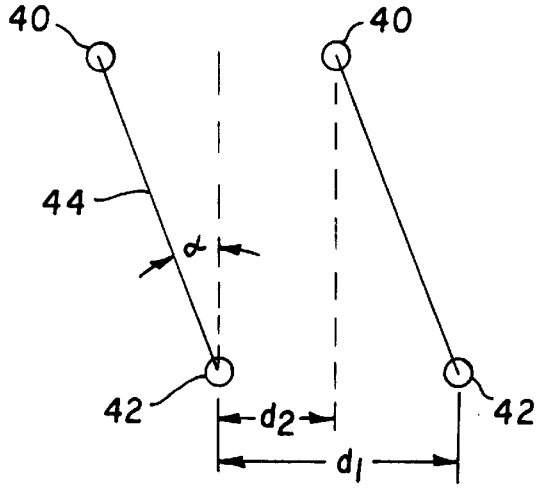
FIG. 4 is a is a diagram useful in explaining the effect of the present invention.

The increased resolution is provided as shown in FIG. 2, by providing two transfer locations 40 and 42 for each line of developer 44, and angling the lines of developer 44 with respect to receiver 34 by angling the print head 12 with respect to the receiver 34. Alternatively, the increased resolution may be provided as shown in FIG. 3 by angling the lines of developer 44 on the print head 12. Referring to FIG. 4, a 400 line per inch print head ($d_1$=63.5 microns) having electrodes 40 and 42 spaced 300 microns apart along the lines of developer 44, and angled by an angle $\alpha$ of 6.1° from the direction of the motion of the receiver will produce an 800 line per inch ($d_2$=31.8 microns) printer. Preferably, the lines of developer are spaced apart by between 40 and 200 microns. It will be understood that appropriate timing delays in the pulses sent to the transfer electrodes 40 and 42 are incorporated to account for the fact that the transfer electrodes do not all fall on a single line on the print head 12.

Figure 5:
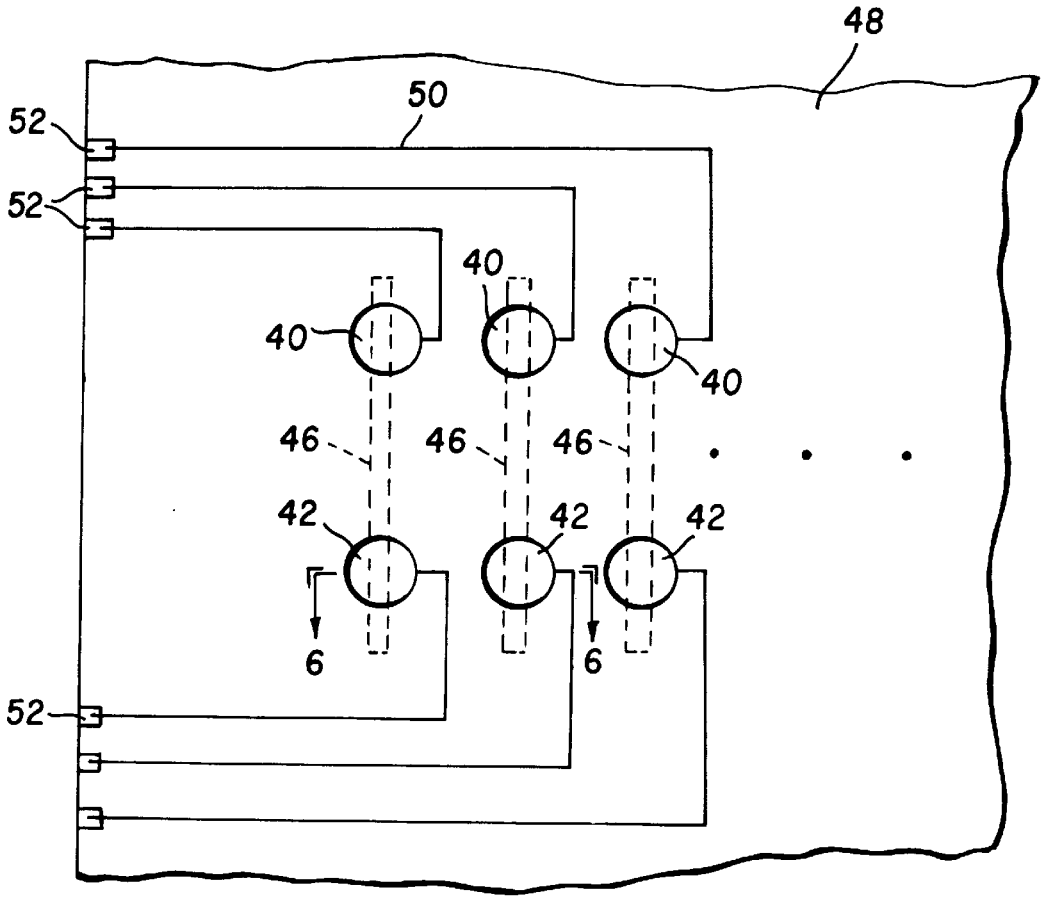
FIG. 5 is a partial plan view of a print head according to the present invention employing magnetic strips to form lines of developer.
Figure 6:
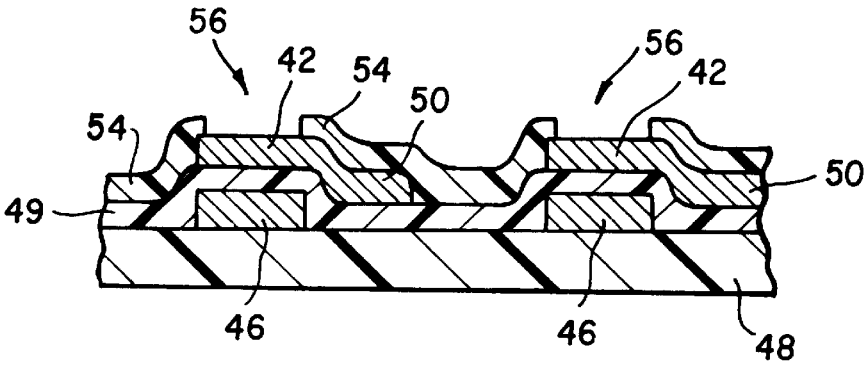
FIG. 6 is a partial cross sectional view of the print head shown in FIG. 5 taken along lines 6—6.

Referring to FIG. 5 and 6, one way of forming parallel lines of developer in the present invention is to employ a print head 12 having a plurality of magnetic strips 46, such as permalloy, on an insulating substrate 48, such as a flex circuit material. This approach to forming lines of developer is the subject of copending U.S. Ser. No. 08/294,294, filed Aug. 23, 1994, now abandoned in favor of C.I.P. application U.S. Ser. No. 08/783,953, filed Jan. 16, 1997, entitled "Electrographic Printing Process and Apparatus" by William Mey et al. The magnetic strips 46 may be electrically nonconducting, or they are electrically insulated by a layer of insulation 49. Transfer electrodes 40 and 42 are located over the strips 46. The transfer electrodes 40 and 42 are nonmagnetic and are connected to nonmagnetic conductors, such as copper circuit board traces 50 and thence to contact pads 52. Circuit traces 50 are covered by an electrically insulating layer 54, such as a photopolymer. The insulating layer 54 is provided with holes 56 located over the transfer electrodes 40 and 42, for example by photofabrication. As magnetic developer 28 is moved over the print head 12 by magnetic brush 10, the magnetic strips 46 cause the developer to form separate lines over the magnetic strips. When a sufficient voltage, on the order of 100 volts, is applied to the magnetic strips by the printer control circuit 13, toner is transferred from the line of toner on the print head 12 to the receiver 34.

Figure 7:
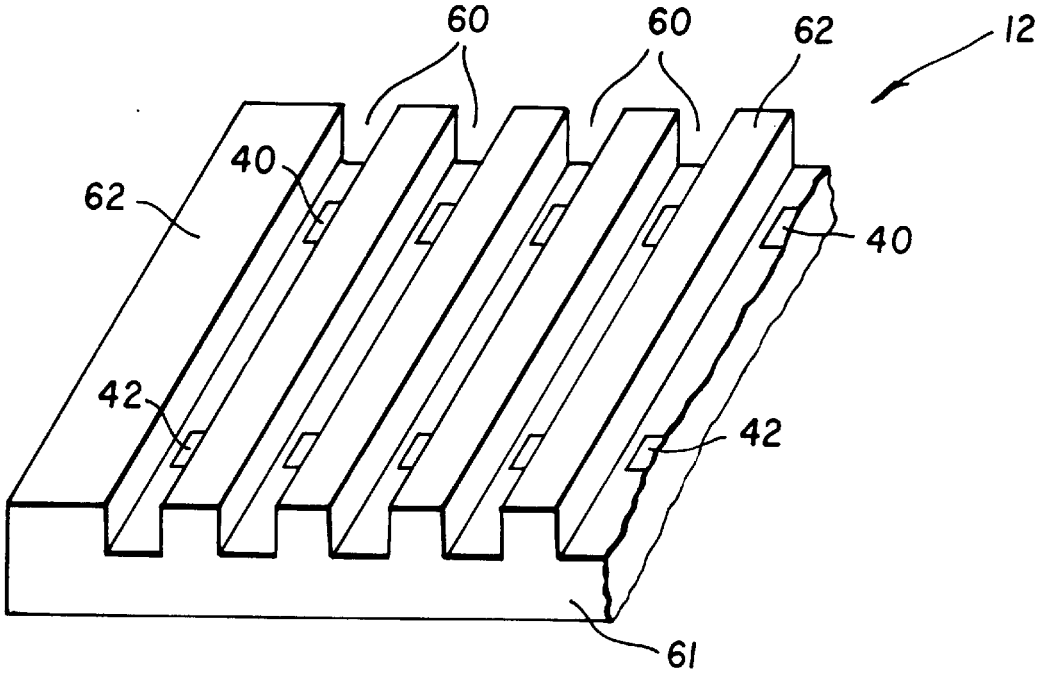
FIG. 7 is a partial perspective view of a print head according to the present invention employing microchannels to form lines of developer.

Alternatively, as shown in FIG. 7, the print head 12 includes a plurality of parallel microchannels 60 on a substrate 61 separated by channel walls 62 that function to form a plurality of parallel lines of developer in the microchannels 60. This approach to forming lines of developer is the subject of U.S. Ser. No. 08/620,655, filed Mar. 22, 1996, now abandoned in favor of C.I.P. application U.S. Ser. No. 08/782,272, filed Jan. 13, 1997, entitled "MICROCHANNEL PRINT HEAD FOR ELECTROGRAPHIC PRINTER" by W. Grande, et al. The microchannels 60 are at least wider than the largest developer particles (e.g. 8 to 50 microns) and channel walls 62 are preferably in the range of 10 to 200 microns wide. The width of the channels plus the width of the walls determines the distance between the channels, thus, the spacing between channels will be between 18 and 250 microns, preferably 40 to 200 microns. The print head width is determined by the number and spacing of the transfer locations per line of developer, and the angle of the lines with respect to the print head. For example, for a print head having six transfer locations angled at 10° spaced apart by 244 microns along the line, the print head is 1.2 mm wide and as long as a full page width (e.g. 21.6 cm). Alternatively, a print head shorter than a page width (e.g. 2.5 cm) may be used and scanned across the page to provide full page printing. Preferably, the number of transfer locations in a line is in the range of 4 to 16.

A pair of electrically conducting transfer electrodes 40 and 42 is located in each channel for transferring toner from the channel to the receiver 34. To obtain a higher resolution printer (e.g. 600 dots per inch) the microchannels are angled with respect to the receiver by either angling the print head 12 as shown in FIG. 2, or angling the microchannels on the print head 12, as shown in FIG. 3. In one embodiment the substrate 61 is silicon and the microchannels 60 are formed in the surface of the silicon using known micromachining techniques. In this case the transfer electrodes 40 and 42 are formed using conventional integrated circuit manufacturing techniques. Additionally, a portion of the control circuitry, such as current drivers for applying printing voltage pulses to the electrodes 40 and 42, may be integrated into the substrate 61. Alternatively, the transfer electrodes and control circuitry may be integrated into a silicon substrate and the channel walls formed on the substrate using a photopolymer and photolithography. According to a further alternative, the microchannel print head is fabricated on a flexible substrate, such as flex circuit material, and the microchannels are formed by a photolithograhic process using photopolymer. To further restrain the developer to the microchannels, strips of magnetically permeable material similar to those shown in FIG. 5 may be located in the bottoms of the microchannels.

Figure 8:
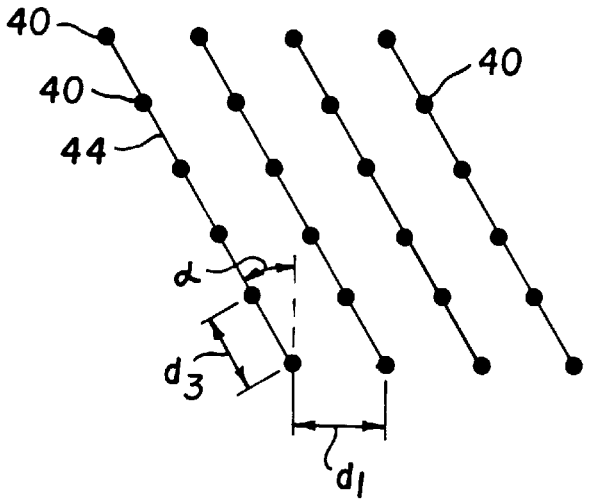
FIG. 8 is a diagram useful in describing the operation of a printer according to the present invention having redundant transfer locations from each line of developer.

Although the invention has been described as providing two transfer locations per line of developer, it will be understood that more than two transfer locations per line may be used. The final resolution of the printer is determined by a combination of the distance between the transfer locations, the angle of the line with respect to the receiver and the orientation of the transfer locations from line to line. The same resolution can be obtained for any arbitrary distance between electrodes (thereby minimizing cross talk) by adjusting the angle of the channels. Of course, the transfer electrode must be sized for the appropriate resolution. The wall thickness can be large and depends upon the channel angle. By sufficiently angling the channels and providing a sufficient number of transfer locations per channel, potentially overlapping transfer locations may be provided for use in gray level printing, or as redundant backup electrodes in case of failure. For example, as shown in FIG. 8, lines of developer 44 angled at $\alpha=10°$, spaced at 300 lines per inch ($d_1$=85 microns), having 6 transfer locations 40 spaced apart by 244 microns ($d_3$), produced a printer having 600 dpi resolution with eight possible gray levels per dot. Alternatively, the three possible transfer electrodes per dot may be employed to provide triple redundancy for each transfer location per dot. It is understood that the first and last two dots in each line are not triply redundant. These first and last few printing positions may not be used in the print head.

If the print head is flat and the receiver is mounted on a drum as shown in FIG. 1, the distance between the transfer locations and the receiver may vary with electrode location. As a result, the electric field, and hence toner transfer efficiency could be different for different transfer locations within a line of developer. Transfer locations closer to the receiver may produce a more dense dot than those further away from the receiver. This effect can be avoided by flattening the receiver in the region of toner transfer, for example by employing a flat surface, such as a platen or a flexible belt. Alternatively, different voltages may be applied to the electrodes to keep a constant electric field between the receiver and electrode.

The invention has been described with reference to a preferred embodiment. However, it will be appreciated that variations and modifications can be effected by a person of ordinary skill in the art without departing from the scope of the invention.

PARTS LIST

10 magnetic brush
12 print head
13 print head control circuit
14 receiver electrode
15 stepper motor
16 developer supply
18 developer supply

20 developer supply
22 rotatable magnetic core
24 stationary outer shell
25 permanent magnetic sector
26 developer sump
28 magnetic developer
30 rotatable magnetic feed roller
32 recording region
34 receiver
36 fusing station
38 lip
40 transfer location
42 transfer location
44 line of developer
46 magnetic strip
48 insulating substrate
49 insulation layer
50 circuit trace
52 contact pad
54 electrically insulating layer
56 hole
60 microchannel
61 substrate
62 channel walls

We claim:

1. Electrographic printing apparatus for forming a toner image on a recording medium, comprising:

a) a magnetic brush having a rotatable magnetic core and a stationary outer shell;

b) a developer supply for supplying a magnetic developer powder including toner to the magnetic brush;

c) a print head on the outer shell, the print head including means for forming a plurality of parallel lines of developer, and means for selectively transferring dots of toner from two or more locations within each line to a receiver moving relative to the print head, the parallel lines of developer being arranged at an angle substantially less than 90° with respect to the direction of movement of the receiver, such that the effective spacing between dots of toner is less than the distance between the parallel lines of developer; and d) a receiver electrode arranged in spaced relation to the transfer means to define a recording region through which the receiver is moved.

2. The electrographic printing apparatus claimed in claim 1, wherein the spacing between the lines of developer is between 40 and 200 microns.

3. The electrographic printing apparatus claimed in claim 1, wherein the means for forming a plurality of parallel lines of developer comprise a plurality of strips of magnetically permeable material, the means for transferring toner comprise transfer electrodes arranged over the magnetic strips, and further comprising means for electrically insulating the strips from the transfer electrodes.

4. The electrographic printing apparatus claimed in claim 1, wherein the means for forming a plurality of parallel lines of developer comprise a plurality of microchannels and the means for transferring toner comprise transfer electrodes located in the microchannels.

5. The electrographic printing apparatus claimed in claim 4, wherein the print head comprises a nonflexible substrate having microchannel walls formed from photoimageable polymer.

6. The electrographic printing apparatus claimed in claim 4, further comprising strips of magnetically permeable material located in the microchannels.

7. The electrographic printing apparatus claimed in claim 4, wherein the print head comprises a silicon substrate having microchannels in the surface thereof.

8. The electrographic printing apparatus claimed in claim 7, further comprising a circuit for selectively applying printing voltage pulses to the transfer electrodes, the circuit being integrated into the silicon substrate.

9. The electrographic printing apparatus claimed in claim 1, wherein the developer is a dual-component developer.

10. The electrographic printing apparatus claimed in claim 1, wherein the number of transfer locations in each line is between 4 and 16.

11. An electrographic printing method, comprising the steps of:

a) supplying a magnetic developer to a print head;

b) confining the developer at the print head to form a plurality of parallel lines of developer, the lines of developer being arranged at an angle substantially less than 90° with respect to a direction of relative movement between the print head and a receiver; and c) selectively transferring developer in an imagewise manner from a plurality of locations within each of the lines of developer to the receiver.

12. The electrographic printing method claimed in claim 11, wherein the developer is a dual-component developer.

13. The electrographic printing method claimed in claim 11, wherein the developer is confined using an array of magnetically permeable strips.

14. The electrographic printing method claimed in claim 11, wherein the developer is confined using microchannels.

15. A print head for an electrographic printer of the type having a magnetic brush for transporting magnetic developer to a recording region and a receiver for receiving an imagewise pattern of a component of the developer at the recording region, comprising:

a) a substrate defining a plurality of parallel microchannels for confining the developer to flow in the microchannels, the microchannels being arranged at an angle to a direction of relative movement between the receiver and the print head; and b) a plurality of selectively addressable transfer electrodes located at the bottom of each microchannel for selectively transferring the component of the developer to the receiver from the microchannel.

16. The print head claimed in claim 15, wherein the substrate is silicon.

17. The print head claimed in claim 16, further comprising a strip of magnetically permeable material located in each microchannel.

18. The print head claimed in claim 16, wherein the transfer electrodes are integrated into the silicon substrate.

19. The print head claimed in claim 18, further comprising circuitry for selectively applying charge to the transfer electrodes, the circuitry being integrated into the silicon substrate.

20. The electrographic printing apparatus claimed in claim 15, wherein the print head comprises a flexible substrate having microchannel walls formed from photoimageable polymer.

21. The electrographic printing apparatus claimed in claim 15, wherein the print head includes redundant transfer locations.

22. The electrographic printing apparatus claimed in claim 15, wherein the magnetic developer is a single component magnetic developer.

* * * * *